US008074469B2

(12) United States Patent
Hamel et al.

(10) Patent No.: US 8,074,469 B2
(45) Date of Patent: Dec. 13, 2011

(54) REFRIGERATOR WITH A CONVERTIBLE COMPARTMENT

(75) Inventors: Timothy Allen Hamel, Louisville, KY (US); Rita Barksdale, Louisville, KY (US); Chris George Bissig, Sellersburg, IN (US); John R. Brumleve, Louisville, KY (US); Jonathan Crosby, Lockport, NY (US); Rajesh Swarnkar, Chhattisgarh (IN); Thomas F. White, Louisville, KY (US); Martin Mitchell Zentner, Prospect, KY (US)

(73) Assignee: General Electric Company, Schenectady, NY (US)

( * ) Notice: Subject to any disclaimer, the term of this patent is extended or adjusted under 35 U.S.C. 154(b) by 472 days.

(21) Appl. No.: 12/347,284

(22) Filed: Dec. 31, 2008

(65) Prior Publication Data

US 2010/0162747 A1 Jul. 1, 2010

(51) Int. Cl.
*F25D 11/02* (2006.01)

(52) U.S. Cl. ..... 62/441; 62/443

(58) Field of Classification Search ..... 62/441, 62/455, 419, 408, 314, 414, 351, 443, 126, 62/129; 454/140, 229; 312/116, 117; 700/153, 700/202

See application file for complete search history.

(56) References Cited

U.S. PATENT DOCUMENTS

| | | | | |
|---|---|---|---|---|
| 5,172,566 | A * | 12/1992 | Jung et al. | 62/186 |
| 5,737,939 | A * | 4/1998 | Valence et al. | 62/441 |
| 5,758,512 | A | 6/1998 | Peterson et al. | |
| 6,725,678 | B2 | 4/2004 | Chang et al. | |
| 7,051,539 | B2 | 5/2006 | Junge et al. | |
| 2005/0183429 | A1 * | 8/2005 | Rafalovich et al. | 62/155 |
| 2006/0086126 | A1 | 4/2006 | Montuoro | |
| 2006/0266059 | A1 * | 11/2006 | Wetekamp et al. | 62/187 |
| 2007/0137226 | A1 * | 6/2007 | Kim et al. | 62/180 |
| 2007/0180849 | A1 * | 8/2007 | Walker et al. | 62/441 |
| 2007/0277538 | A1 * | 12/2007 | Buck | 62/150 |
| 2008/0156006 | A1 * | 7/2008 | Hamel et al. | 62/173 |

FOREIGN PATENT DOCUMENTS

JP 10-171762 1/2000

* cited by examiner

*Primary Examiner* — Mohammad Ali

(74) *Attorney, Agent, or Firm* — Global Patent Operation; Douglas D. Zhang

(57) ABSTRACT

A refrigerator includes a first compartment, a second compartment and a multi-functional compartment that is disposed between the first compartment and the second compartment and is adjustable between temperature modes selected from the group consisting of a fresh food temperature mode, a soft freeze mode, a freezer mode and a chiller temperature mode.

20 Claims, 13 Drawing Sheets

REFRIGERATOR WITH A CONVERTIBLE COMPARTMENT

BACKGROUND OF THE INVENTION

The present disclosure relates generally to refrigerators. More specifically, the present disclosure relates to a refrigerator that includes a compartment that is adjustable between various functional modes to provide a user with the ability to change the compartment from one refrigeration mode to another refrigeration mode.

U.S. Pat. No. 5,758,512 to Peterson et al. discloses a refrigerator having a middle fresh food compartment, a relatively large bottom freezer compartment arranged below the fresh food compartment and a relatively small top freezer compartment arranged above the fresh food compartment. Two fans are used in conjunction to distribute cooling air from around a single evaporator to the two freezer compartments to control the temperatures therein. Peterson et al. is energy deficient because these two fans must be continuously running during the operation of the refrigerator.

U.S. Pat. No. 6,725,678 to Chang et al. discloses a refrigerator with a multipurpose storage chamber that is positioned in the fresh food compartment and can be used to store a variety of foods. A guiding path of refrigerated air is provided to guide cool air to the multipurpose storage container. A flap, which is controllable at an open angle, is provided to control the amount of cooling air provided to the multipurpose storage chamber. Chang et al. is deficient as temperature control of the multipurpose storage chamber is made using a variable angle dampening device, which lacks precision in the temperature control of the multipurpose chamber. By modulating the angle, one would still need to wait a period of time before the temperature in the chamber increases. If one wants to convert this chamber to store relatively higher temperature items, this conversion or temperature adjustment would take a long period of time to occur. Additionally, the positioning of the chamber is not advantageous because the user needs to access the housing compartment first to access the chamber that is inconveniently located within the compartment. Finally, given the chamber's proximity to the evaporator and size, generally, temperatures in the chamber would be frigid, and this arrangement does not provide the user with the flexibility of using the chamber for a range of items, such as, a chiller configuration, or for storing relatively higher temperature items.

BRIEF DESCRIPTION OF THE INVENTION

As described herein, the exemplary embodiments of the present disclosure overcome one or more of the above or other disadvantages known in the art.

According to a first aspect, there is provided a refrigerator that includes a first compartment and a second compartment. The refrigerator also includes a multi-functional compartment that is positioned between the first compartment and the second compartment and is adjustable between temperature modes selected from the group consisting of a fresh food temperature mode, a soft freeze mode, a freezer mode, and a chiller temperature mode.

According to another aspect, the refrigerator includes a fresh food compartment and a freezer compartment. The refrigerator also includes a multi-functional compartment that is positioned between the fresh food compartment and the freezer compartment and is adjustable between temperature modes selected from the group consisting of a fresh food temperature mode, a soft freeze mode, a freezer mode, and a chiller temperature mode.

In yet another aspect, the refrigerator includes a fresh food compartment; a freezer compartment disposed below the fresh food compartment; a multifunctional compartment disposed between the fresh food compartment and the freezer compartment; a heater disposed in the multifunctional compartment for increasing temperature in the multifunctional compartment; a sub-compartment; an evaporator disposed in the sub-compartment; a fan for distributing cooling air from the sub-compartment to the multifunctional compartment; a temperature sensor disposed in the multifunctional compartment for generating a temperature signal representing the temperature within the multifunctional compartment; and a controller operatively connected to the temperature sensor and the heater. The controller is configured to energize at least one of the heater and the fan after the temperature signal reaches a threshold.

These and other aspects and advantages of the preferred embodiments of the present disclosure will become apparent from the following detailed description considered in conjunction with the accompanying drawings. It is to be understood, however, that the drawings are designed solely for purposes of illustration and not as a definition of the limits of the present disclosure, for which reference should be made to the appended claims. Moreover, the drawings are not necessarily drawn to scale and that, unless otherwise indicated, they are merely intended to conceptually illustrate the structures and procedures described herein.

BRIEF DESCRIPTION OF THE DRAWINGS

In the drawings:

FIGS. 3A-6A are simplified side cross-sectional views of the refrigerators of FIG. 3-6, respectively.

DETAILED DESCRIPTION OF THE EXEMPLARY EMBODIMENTS OF THE INVENTION

Figure 1:
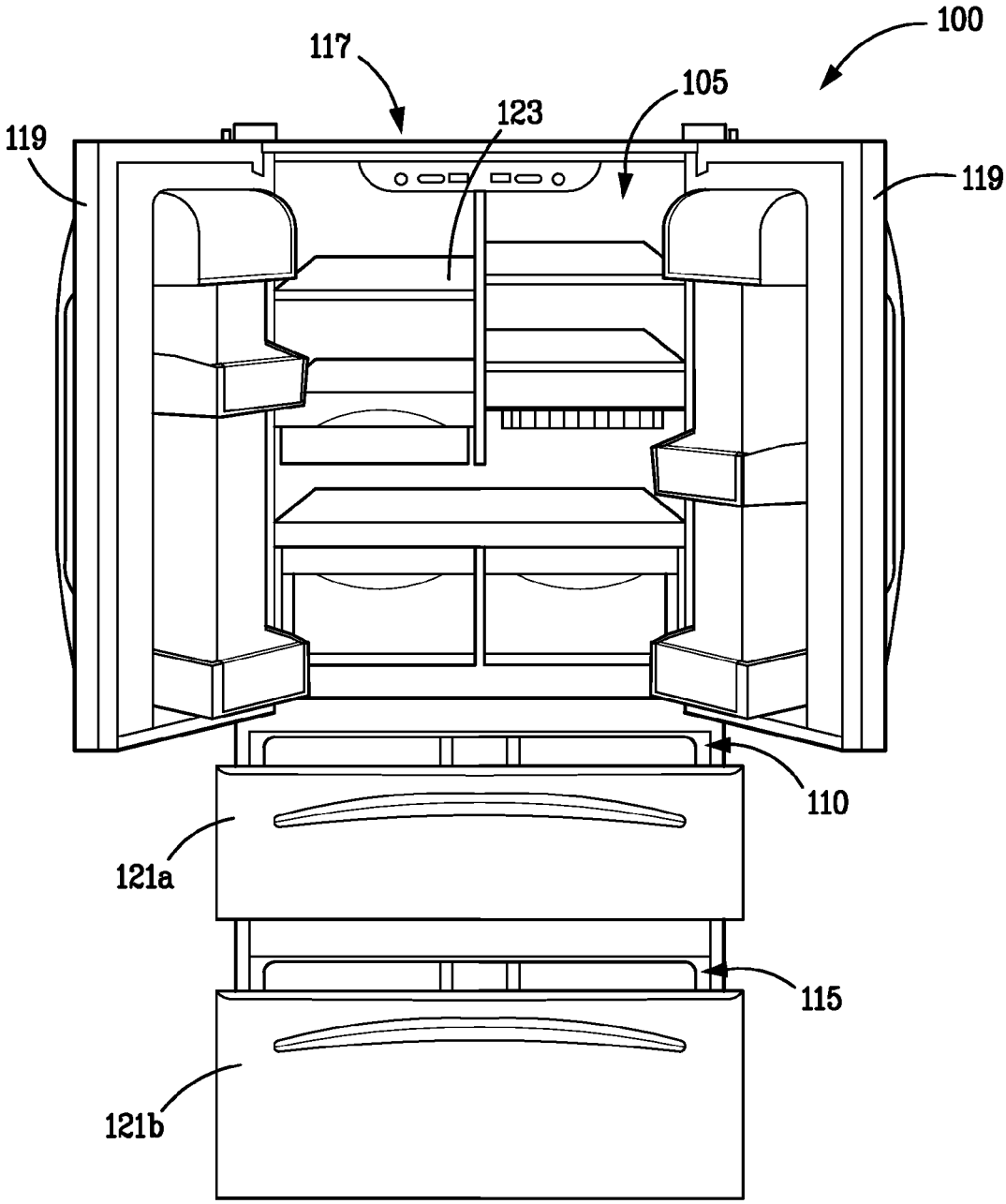
FIG. 1 is a front view, showing a refrigerator according to an exemplary embodiment of the present disclosure, with all of the doors and drawers being opened; the refrigerator having a multifunctional compartment located between a top fresh food compartment and a bottom freezer compartment.
Figure 2:
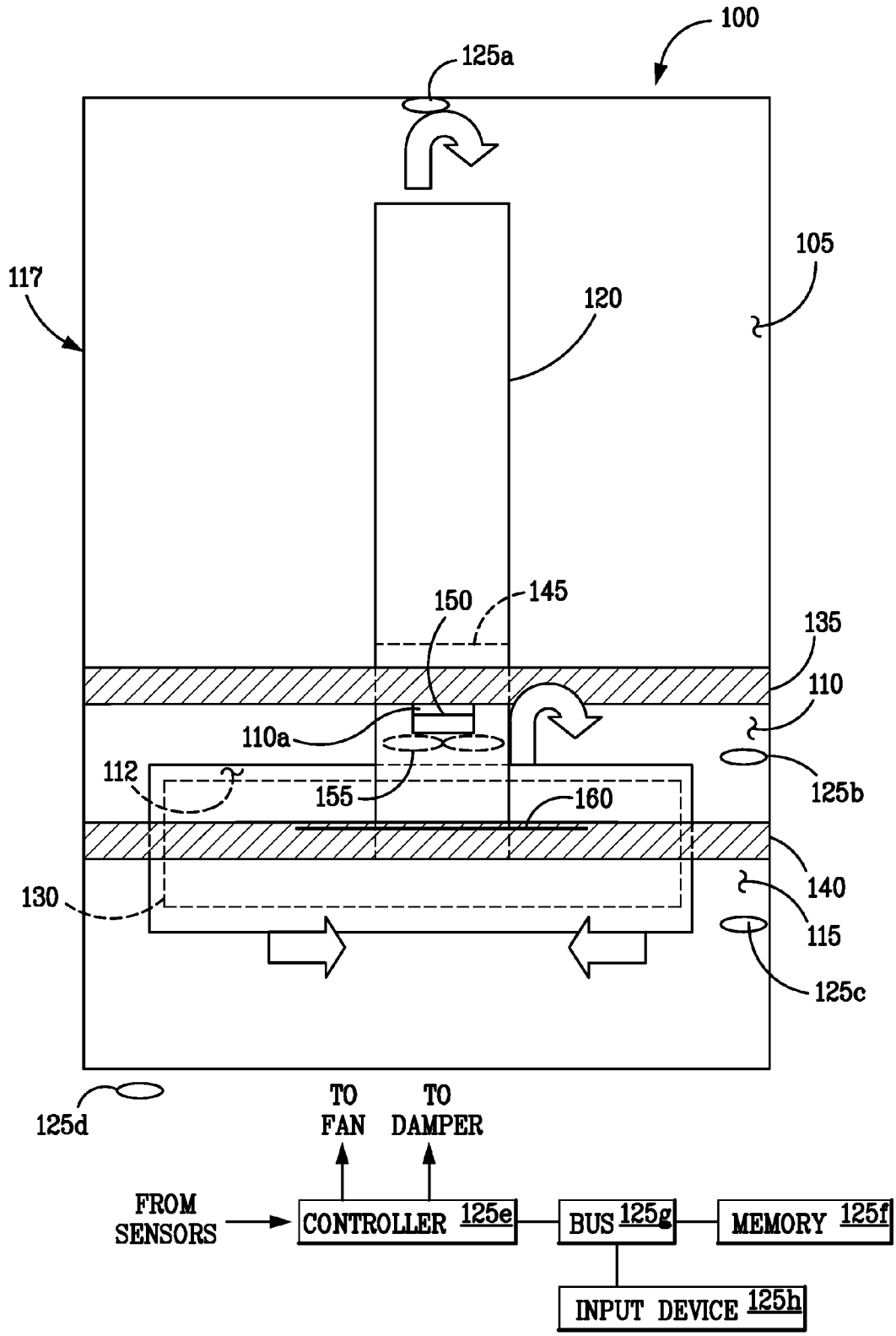
FIG. 2 is a simplified front view, schematically showing the airflow in the refrigerator of FIG. 1; the doors and the drawers have been removed for clarity.

As shown in FIGS. 1 and 2, the present disclosure is directed to a multi-compartment refrigerator unit 100 that includes three compartments defined within a cabinet structure 117. More specifically, in the illustrative embodiment of FIGS. 1 and 2, the refrigeration unit 100 includes a first or upper compartment 105, a second or middle compartment 110, and a third or lower compartment 115.

As shown in FIG. 1, the compartment 105 preferably includes a pair of access doors 119 each pivotably attached to the main body or chassis of the refrigerator unit 100 as is conventional in the art to permit access to the compartment 105. The compartments 110 and 115 may include drawers 121*a* and 121*b* so that a user may slide a drawer relative to guide rails (not shown) mounted to the main body or chassis of the refrigerator unit 100 to permit access to the respective compartment. It should be appreciated that the refrigeration unit 100 may have shelves 123 extending in some or all of the compartments 105, 110, 115, and other optional assemblies (not shown) to advance the functionality of the refrigeration unit 100.

The user may store refrigerated items in each of the compartments 105, 110, 115 as desired, and open a selected compartment 105, 110 or 115 without accessing the remaining compartments, which can remain closed. Each of the compartments 105, 110, and 115 can have a desired temperature range. For example, the upper compartment 105 may have one temperature range, while the lower compartment 115 may have another, different temperature range. Alternatively, the compartments 110 and 115 can have the same temperature range depending on the needs of the user. The upper compartment 105 stores strictly fresh food. The middle compartment 110 is independently controlled (by a user) as a normal freezer compartment, a soft freeze compartment, a normal refrigerator compartment, or a wine/beverage storage compartment depending on the temperature mode desired by the user. The lower compartment 115 normally functions as a freezer compartment.

As will be more fully described below in connection with FIGS. 2 and 2A, the user can select an actuator to select between several modes and the user can thus control the middle compartment 110 as desired. For example, if the user desires additional freezer storage space, the user may toggle a button of an input device that controls the temperature of the middle compartment 110 to approach a temperature suitable for freezing items. If the user desires a wine chiller compartment, the user again may toggle a button of the input device to control the temperature of the middle compartment 110 to increase the temperature to approach a temperature suitable for storing and chilling wine. Advantageously, this occurs while not disturbing the temperatures of the upper and lower compartments 105, 115, which remain closed. For example, the lower compartment 115's temperature range can be a range that is indicative of a freezer, and may include a below zero degrees Centigrade temperature range, such as between −8 degrees to −14 degrees Centigrade. The upper compartment 105 can be chilled to a temperature that is about 1 degree Centigrade to about 5 degrees Centigrade and can be suitable in temperature for storing fresh foods.

Notably, the middle compartment 110 can be adapted to have a temperature range matching the one temperature range, the another different temperature range discussed above, or even a third, different temperature range. This can be any range known in the art, for example, particularly around a temperature range for a wine chiller, freezer, soft freeze or for fresh food storage. The temperature range can be from approximately 35° F. to approximately 65° F. for the chiller mode, approximately −10° F. to approximately 10° F. for the freezer mode, approximately 10° F. to approximately 32° F. for the soft freeze mode, and approximately 33° F. to approximately 45° F. for the fresh food mode.

Figure 2A:
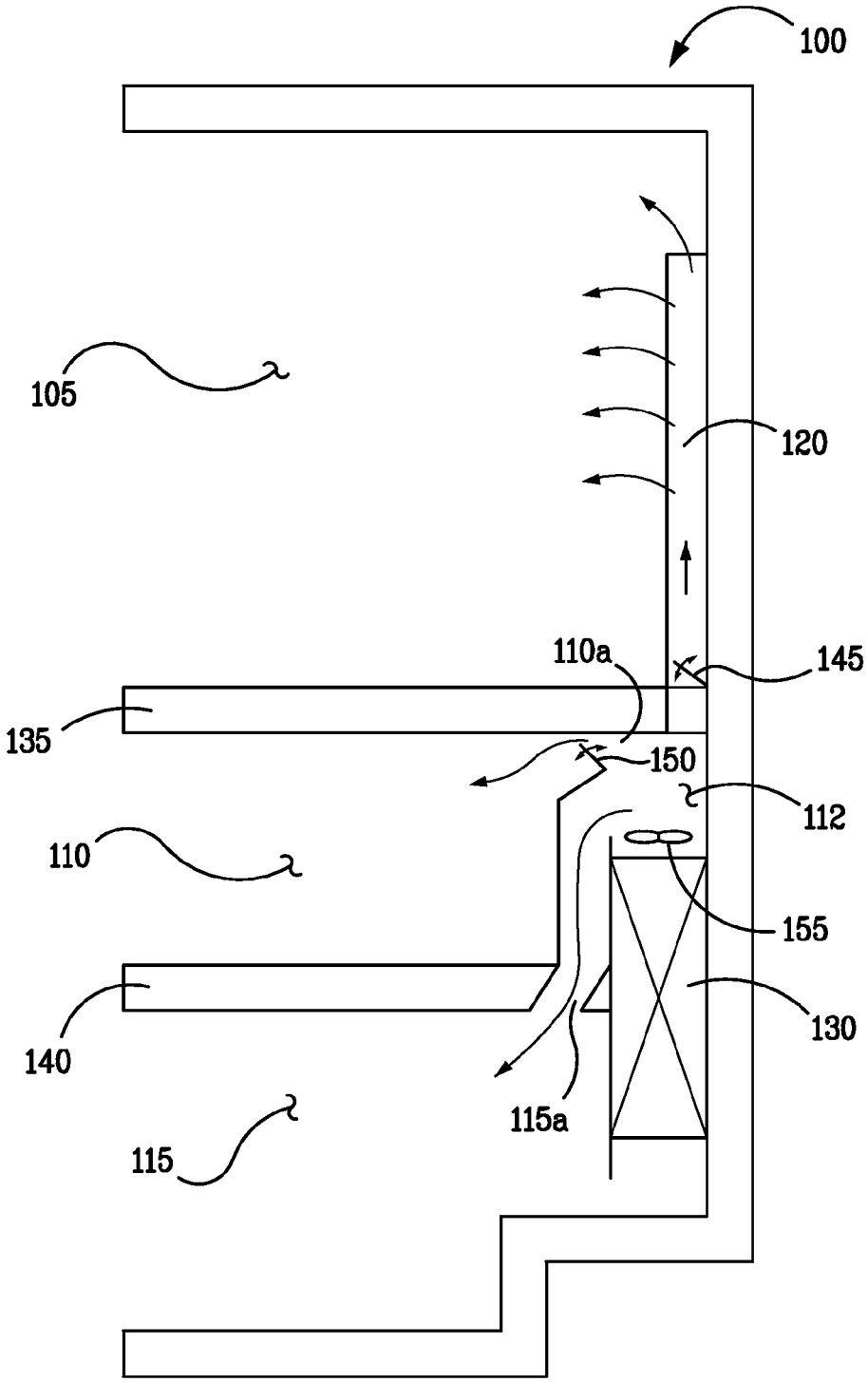
FIG. 2A is a simplified side cross-sectional view of the refrigerator of FIG. 2.

FIGS. 2 and 2A schematically show the unit 100 with the access doors 119 and the drawers 121*a*, 121*b* of the unit 100 being removed for illustration purposes. The unit 100 includes an air tower 120 that extends from the sub-compartment 112 that houses an evaporator 130 of a conventional refrigeration system to an upper location in the upper compartment 105. The air tower 120 is basically a conduit that communicates refrigerated air of a sufficient volume to the upper compartment 105 from the sub-compartment 112. The air tower 120 is shown as generally in a centermost location of the upper compartment 105, but it can be alternatively disposed adjacent to the lateral sides of the unit 100. A temperature sensor 125*a* is disposed in the upper compartment 105 to detect the temperature in the upper compartment 105. Similarly, temperature sensors 125*b*, 125*c* are disposed in the middle compartment 110 and the lower compartment 115, respectively. Each of the temperature sensor 125*e*, 125*b*, 125*c* is preferably a thermistor that outputs a temperature signal to a controller 125*e*.

As clearly shown in FIG. 2A, preferably, the sub-compartment 112 where the evaporator 130 is disposed is positioned immediately behind the middle compartment 110 and the lower compartment 115. Preferably, the sub-compartment 112 extends to cover both the middle compartment 110 and the lower compartment 115. As is known in the art, the evaporator 130 cools the surrounding air when the cooling refrigerant flows through the evaporator 130.

The upper compartment 105 and the middle compartment 110 are separated from one another by a first insulated mullion 135. Similarly, the middle compartment 110 and the lower compartment 115 are separated from one another by a second insulated mullion 140. The first insulated mullion 135 and the second insulated mullion 140 are generally horizontally disposed. In the illustrated embodiment, the insulated mullions 135, 140 include insulating foam or other suitable insulating material therein to maintain the temperatures in the respective compartment 105, 110, 115, and to prevent heat transfer through the mullions 135, 140.

The refrigerator unit 100 also includes a first damper 145, which is shown disposed adjacent to the first mullion 135 for selectively covering a through opening formed on the first mullion 135. The first damper 145 is used to control the amount of the refrigerated or cooling air that can flow into the air tower 120 from the sub-compartment 112. For example, when the first damper 145 is closed, no refrigerated air can flow into the air tower 120. When the first damper 145 is fully opened, the maximum amount of refrigerated air can flow into the air tower 120. In other words, the first damper 145 can provide the selective communication of the refrigerated air as desired. A second damper 150 is used to control the amount of the refrigerator air that can flow into the middle compartment 110 from the sub-compartment 112. As is known in the art, the refrigerated air flows into the middle compartment 110 from the sub-compartment 112 through an opening 110*a* formed on the common wall between the sub-compartment 112 and the middle compartment 110. Preferably, the second damper 150 completely covers the opening 110*a*. The dampers 145, 150 can be electric and/or mechanical type dampers.

As clearly shown in FIG. 2A, preferably, the refrigerated air flows into the lower compartment 115 from the sub-compartment 112 through an opening 115*a* formed on the second mullion 140.

Preferably, a circulatory fan 155 is disposed in the sub-compartment 112 for directing or circulating refrigerated air to the middle compartment 110, the lower compartment 115, and the air tower 120.

The controller 125*e* has a memory 125*f* operatively connected to a bus 125*g*. The bus 125*g* is operatively connected to the dampers 145, 150, and the temperature sensors 125*a*, 125*b*, and 125*c* so that the controller 125*e* can provide program instructions to control each of these and other components. Of course, the controller 125*e* can be operatively connected to the dampers 145, 150, and the temperature sensors 125*a*, 125*b*, and 125*c*, without using the bus 125*g* or the memory 125*f*.

The shown embodiment provides a control based on the compartment temperatures as read by the temperature sensors 125*a*, 125*b*, 125*c*, and by an ambient temperature sensor 125*d*. Suitable airflow is provided by adjusting the dampers 145, 150 and by circulating air with the fan 155 to discharge or distribute an amount of refrigerated air to each of the upper, middle and lower compartments 105, 110, and 115. Refrigerated air is preferably drawn from around the evaporator 130 and distributed to the upper, middle and lower compartments 105, 110, 115.

Figure 2B:
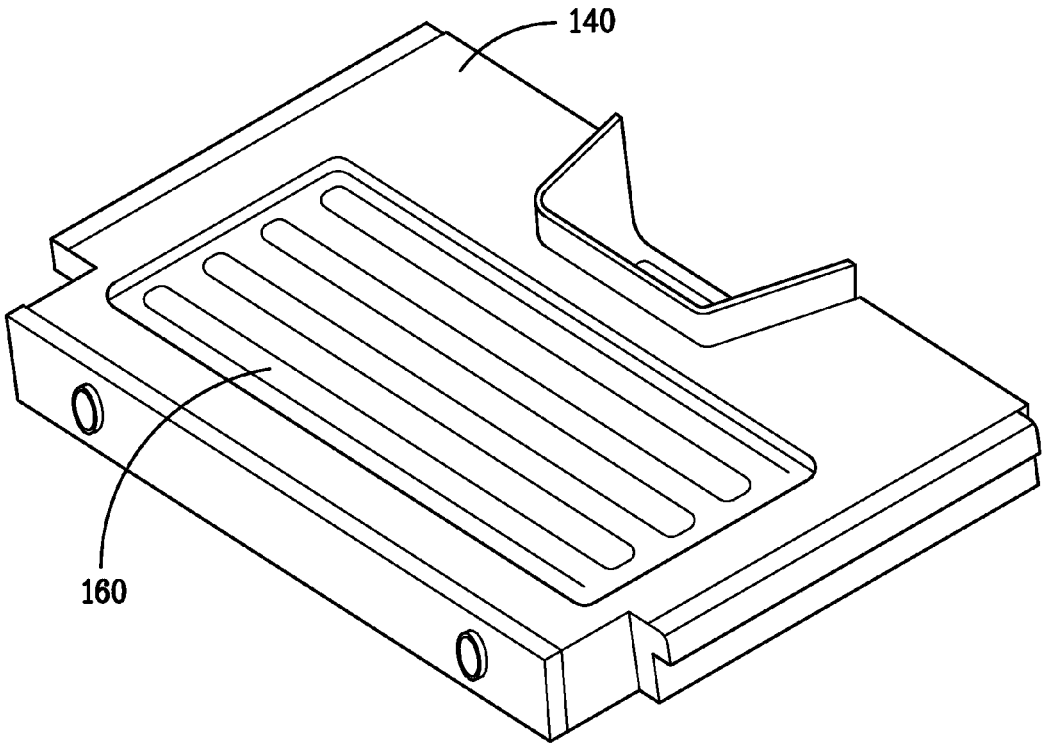
FIG. 2B is a perspective view, showing a mullion including a heater used in the embodiment of FIG. 1.

The middle compartment 110 is advantageously controlled in temperature by cooling the middle compartment 110 by using the refrigerated air from the sub-compartment 112, and/or by heating the middle compartment 110 by using heat generated by a heater 160, which is disposed in the middle compartment 110, preferably on the second mullion 140. FIG. 2B shows the second mullion 140 of FIG. 2. In the exemplary embodiment, the heater 160 is preferably disposed on the top surface of the second mullion 140 to transfer thermal energy into the middle compartment 110. The heater 160 is preferably a resistive heating heater connected to a power source (not shown) that modulates or increases the temperature in the middle compartment 110 to relatively higher temperature ranges than those of the upper compartment 105 (such as for storing beverages or wine), when the user desires such a mode. This provides for a more accurate and quick temperature control of the middle compartment 110 as desired.

In operation, refrigerant is moved through the evaporator 130 for cooling the evaporator 130 according to a specific thermodynamic cycle. Various refrigeration cycles are known in the art, and the present disclosure is not limited to any specific refrigeration thermodynamic cycle. Cooling of the compartments 105, 110, and 115 is accomplished by moving refrigerated air from around the evaporator 130 to the compartments 105, 110, and 115 according to sensed temperatures and the setting of the controller 125*e*.

In the illustrated embodiment, refrigerated or cooling air is communicated from around the evaporator 130 to the middle compartment 110 through the second damper 150. The first damper 145 can be opened by a control signal from the controller 125*e*. This releases refrigerated or cooling air to the upper compartment 105 through the air tower 120. More specifically, the temperature sensor 125*a* communicates a temperature signal to the controller 125*e* that indicates the temperature in the upper compartment 105. If the temperature sensor 125*a* provides a signal indicating the temperature in the upper compartment 105 is above a predetermined threshold (for example, the upper limit of the selected temperature range) for the upper compartment 105, then the controller 125*e* selectively actuates the first damper 145 to open so refrigerated air is circulated to the upper compartment 105 through the air tower 120. The second damper 150 is opened by the controller 125*e* to provide refrigerated air to the middle compartment 110 in a similar manner by referencing a signal from the sensor 125*b*. In the example embodiment, the refrigerator unit 100 also includes a return duct system (not shown) to allow the refrigerated air to circulate from the upper compartment 105 and the middle compartment 110 back to the sub-compartment 112, as is known in the art.

The controller 125*e* also controls the fan 155 which when activated, circulates the refrigerated air from the sub-compartment 112 to the middle compartment 110 (when the second damper 150 is not closed), the upper compartment 105 through the air tower 120 (when the first damper 145 is not closed), and the lower compartment 115.

The user may control an actuator or input device 125*h* to convert the second compartment 105 from a first mode to a different mode where a different temperature range is required. This may include a change from a freezer mode to a refrigeration mode, or from a refrigeration mode to a wine chiller mode, for example. When a change of a functional mode of the middle compartment 110 is desired, the second damper 150 may be opened/closed and/or the heater 160 may be activated/deactivated. When energized, the heater 160 transfers heat to the middle compartment 110 to warm the middle compartment 110 to the desired operating temperature range. In another operational mode, the second damper 150 can remain open, and the heater 160 can be energized to provide an intermediate temperature level in the middle compartment 110.

Figure 3:
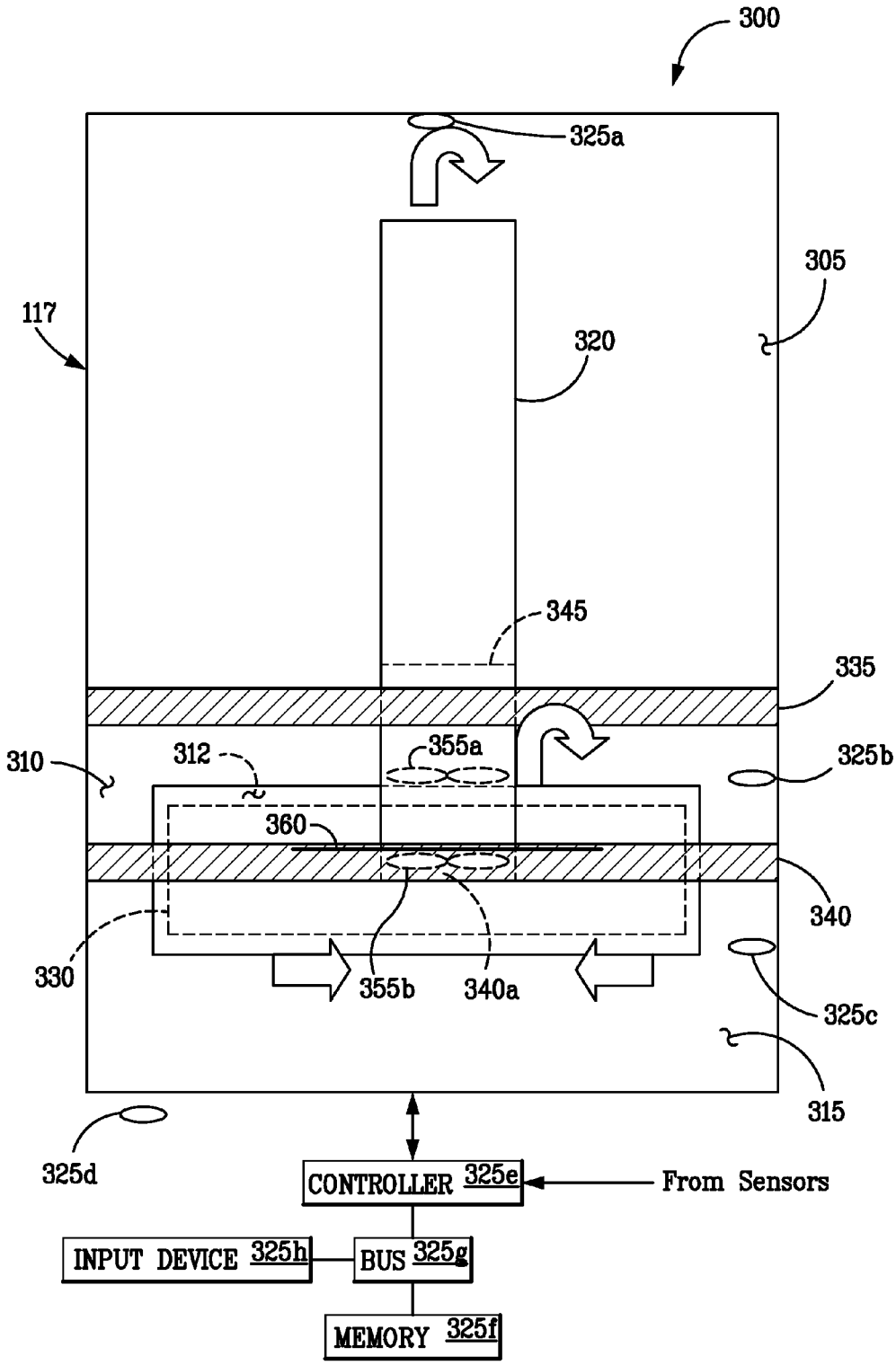
FIGS. 3-6 are simplified front views, schematically showing refrigerators and their respective airflows according to other exemplary embodiments of the present disclosure.
Figure 3A:
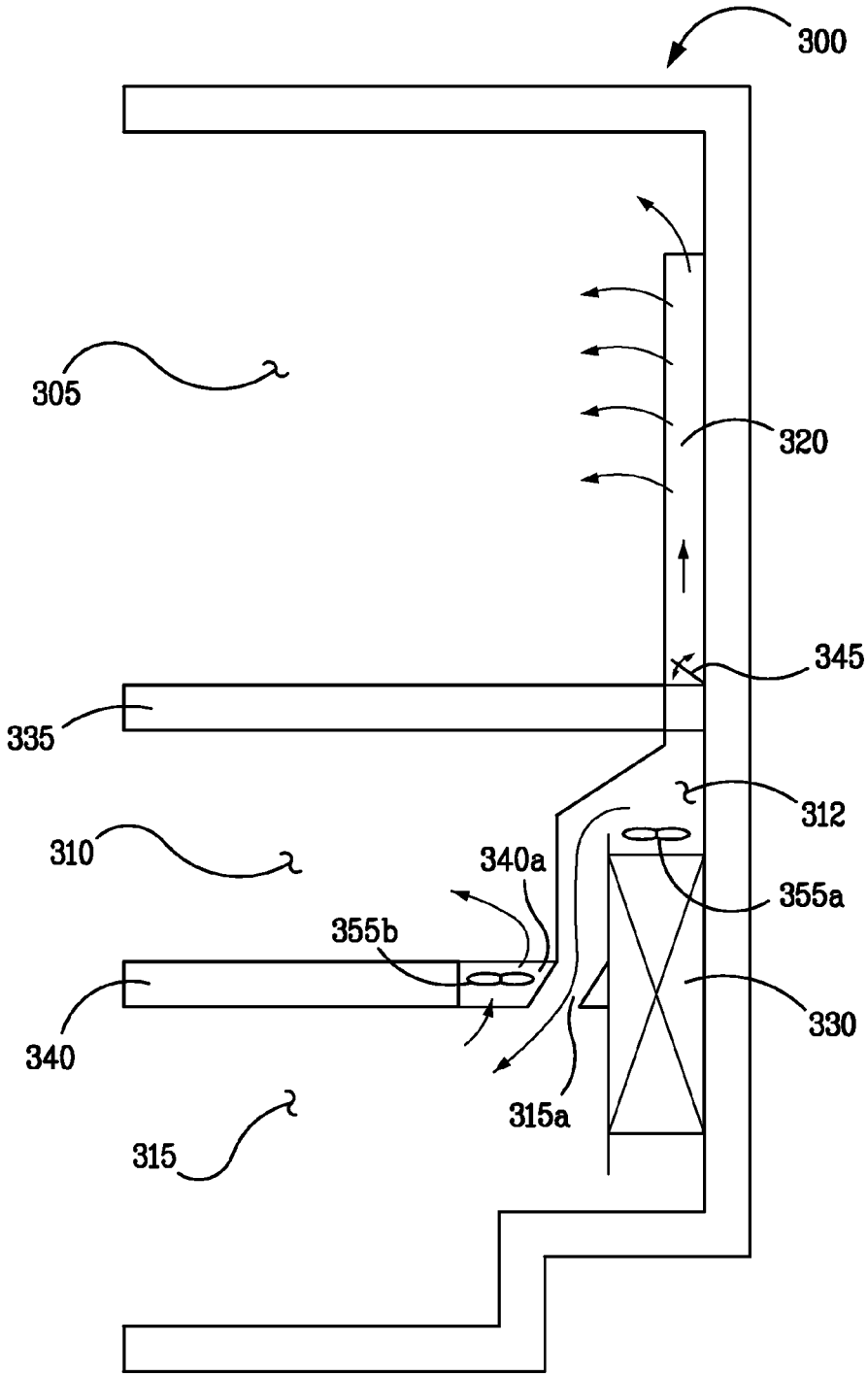

Turning now to FIGS. 3 and 3A, which show another embodiment 300 of the present disclosure. In this embodiment, the same reference numerals plus 200 (i.e., 112 becomes 312) are used to designate the components that are the same or substantially similar to those shown in FIG. 2. When two identical or substantially similar units are used, letters such as "a" and "b" have been added to the chosen reference numeral. The unit 300 includes three compartments 305, 310 and 315 with a temperature sensor (such as, for example, a thermistor) 325*a* disposed in the upper compartment 305, and an air tower 320 extending from the sub-compartment 312 to an upper location in the upper compartment 305. Other sensors 325*b*, 325*c*, and 325*d* may be arranged in the other compartments and at ambient as previously described. Like the fan 155 of FIG. 2, the first fan 355*a* is the main circulating fan for circulating refrigerated air to each of the upper, middle and lower compartments 305, 310, and 315.

However, in this embodiment, a second fan 355*b* is used to circulate refrigerated air from the lower compartment 315 to the middle compartment 310. More specifically, the second mullion 340 has a channel 340*a*, and the second fan 355*b* is preferably disposed in the channel 340*a*. In this embodiment, the unit 300 provides cooling air from the lower compartment 315 to the middle compartment 310 when the controller 325*e* is operable to energize the second fan 355*b*. The controller 325*e* may detect a temperature in the upper compartment 305 via the temperature sensor 325*a*, and provide refrigerated air by opening the first damper 345 so that cooling air can flow from the sub-compartment 312 to the upper compartment 305 via the air tower 320. It should be appreciated that similar to the evaporator 130 of FIG. 2, the evaporator 330 is shared by the middle and the lower compartments 310, 315. In this embodiment, however, only a single damper 345 is used.

Figure 4:
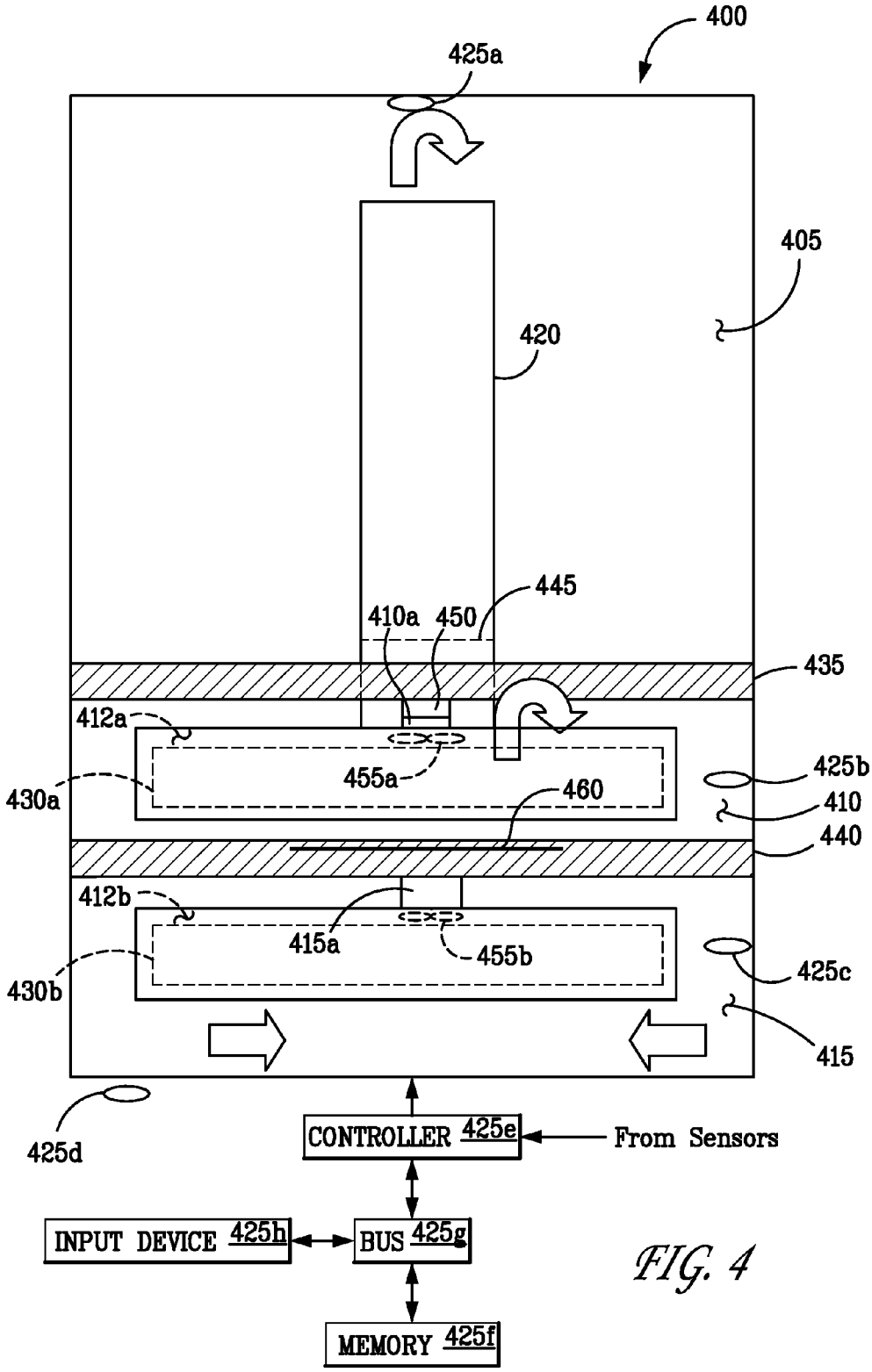
Figure 4A:
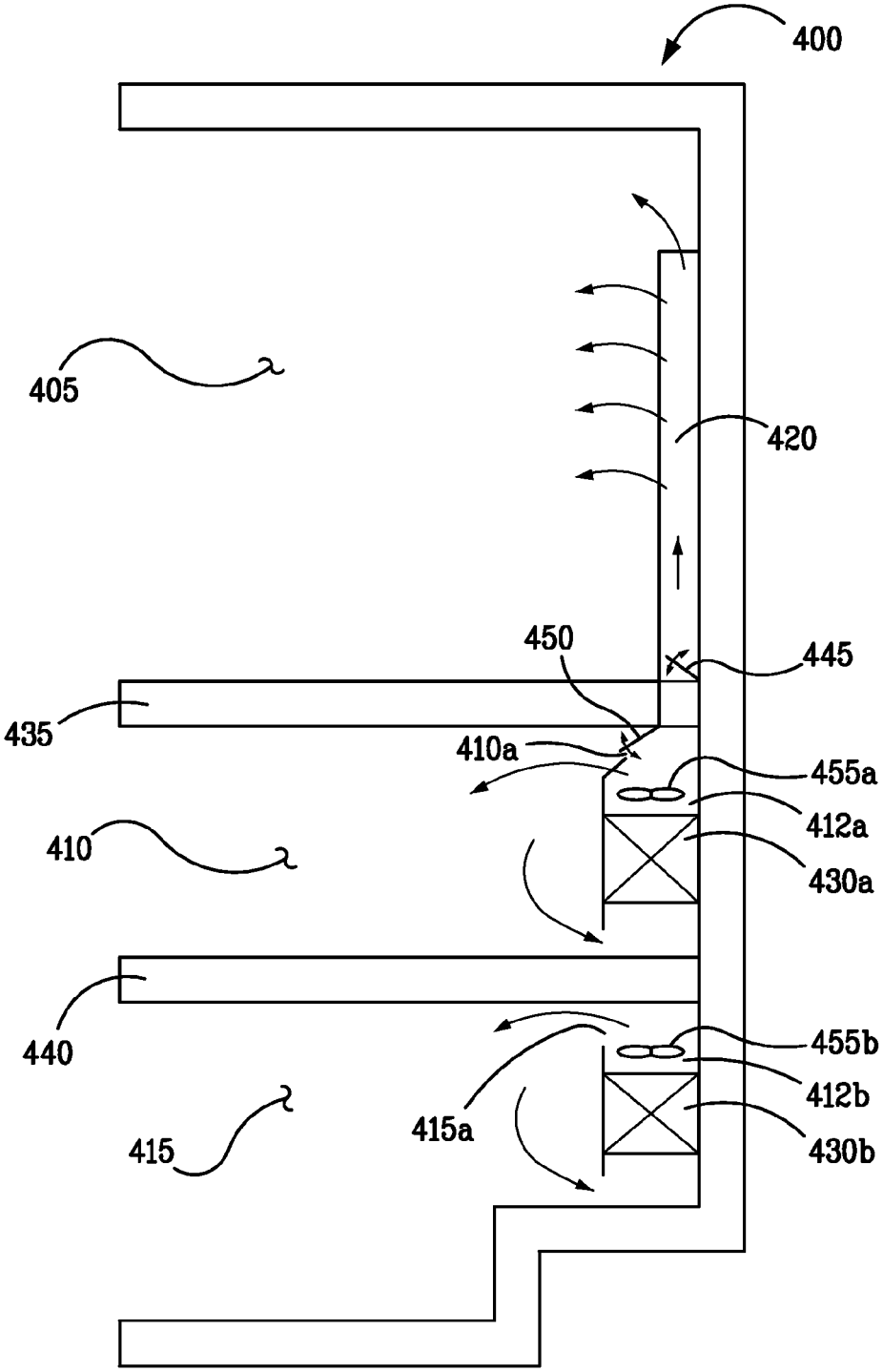

Turning now to FIGS. 4 and 4A, there is shown another embodiment of the present disclosure as reference numeral 400. In this embodiment, the same reference numerals plus 300 (i.e., 112 becomes 412) are used to designate the components that are the same or substantially similar to those shown in FIG. 2. When two identical or substantially similar units are used, letters such as "a" and "b" have been added to the chosen reference numeral. The refrigeration unit 400 includes upper, middle and lower compartments 405, 410, 415 with temperature sensors 425*a*, 425*b*, 425*c* in the upper, middle and lower compartments 405, 410 and 415, respectively, and an ambient temperature sensor 425*d*. An air tower 420 extends from the sub-compartment 412*a* to an upper location in the upper compartment 405. The unit 400 also includes a first fan 455*a* in the sub-compartment 412*a* for circulating or directing the refrigerated air to the middle compartment 410 and the upper compartment 405. Additionally, the unit 400 include a second damper 450 for circulating the refrigerated air from the sub-compartment 412*b* to the lower compartment 415.

A first evaporator 430*a* is disposed in the sub-compartment 412*a* that is preferably positioned immediately behind the middle compartment 410. A second evaporator 430*b* is disposed in the sub-compartment 412*b* that is preferably positioned immediately behind the lower compartment 415. The evaporators 430*a*, 430*b* are independent from one another, and one evaporator 430*a*'s temperature can be controlled differently relative to that of the other evaporator 430*b* by the controller 425*e* to provide a different functionality between the middle and lower compartments 410, 415. However, the evaporators 430*a*, 430*b* can be operatively connected to a common compressor (not shown), or alternatively, the evaporators 430*a*, 430*b* can be operatively connected to their respective compressors (not shown), as is known in the art.

The fan 455*a* is used to direct the refrigerated air from the sub-compartment 412*a* to the middle compartment 410 and the upper compartment 405. Similarly, a fan 455*b* is preferably disposed in the sub-compartment 412*b* for directing the refrigerated air from the sub-compartment 412*b* to the lower compartment 415. A second mullion 440 separates the middle compartment 410 from the lower compartment 415. A heater 460 is used to heat the middle compartment 410. The heat 460 is preferably placed on the top surface of the second mullion 440. In the exemplary embodiment, this unit 400 provides cooling air from around the first evaporator 430*a* to the upper and middle compartments 405, 410 when the controller 425*e* is operable to energize the first fan 455*a*, and open the first and second dampers 445, 450 upon the controller 425*e* receiving a temperature signal from the temperature sensors 425*a* and 425*b*. This unit 400 provides cooling air from around the second evaporator 430*b* to the lower compartment 415 when the controller 425*e* is operable to energize the second fan 455*b*. When desired, the user can change a mode of the middle compartment 410 by engaging an actuator or input device 425*h*. In response, the heater 460 may be energized to heat the middle compartment 410 to the desired operable temperature range. As discussed earlier, the middle compartment 410 can receive refrigerated air and heat to control or adjust the temperature therein.

Figure 5:
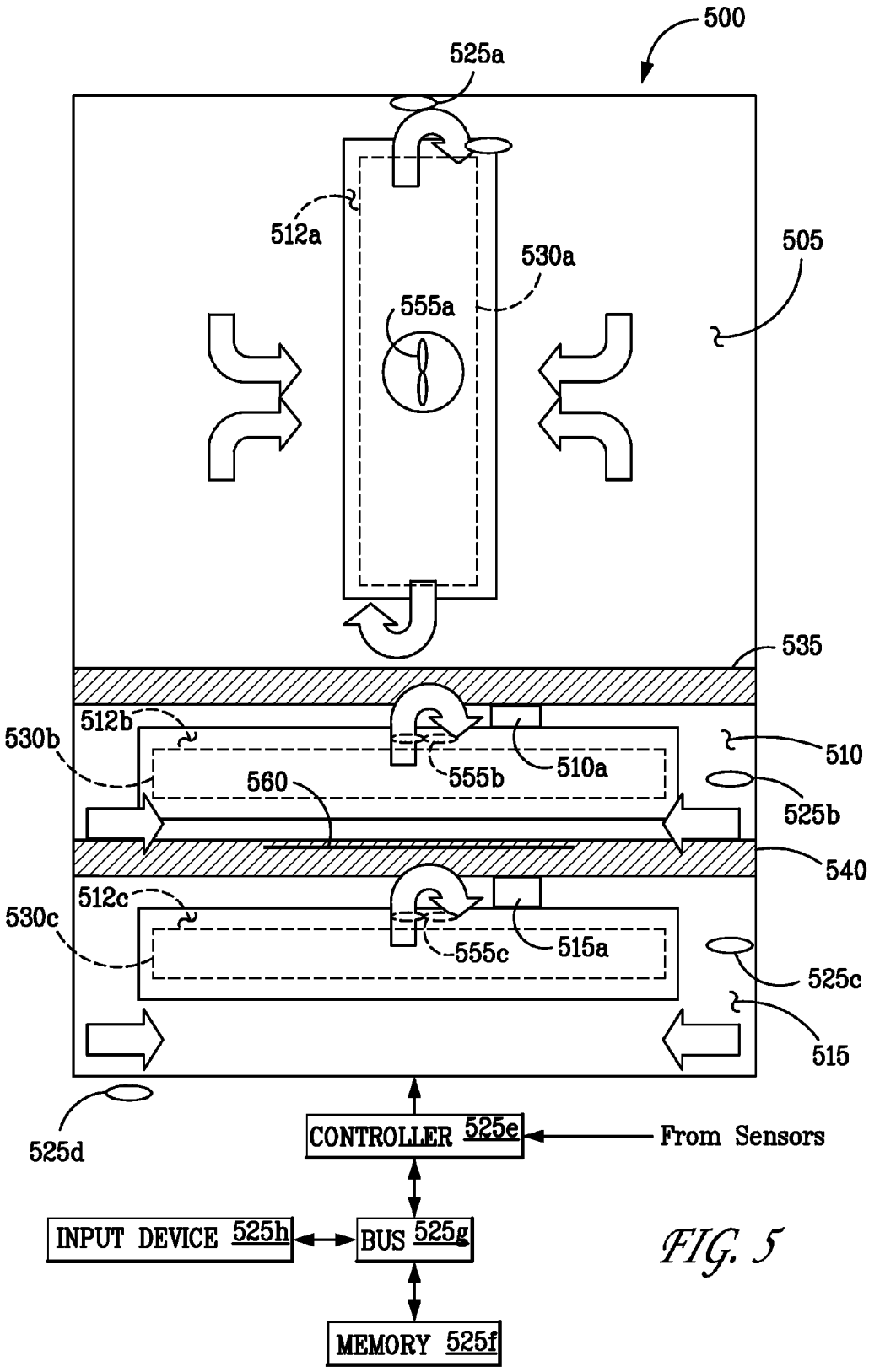
Figure 5A:
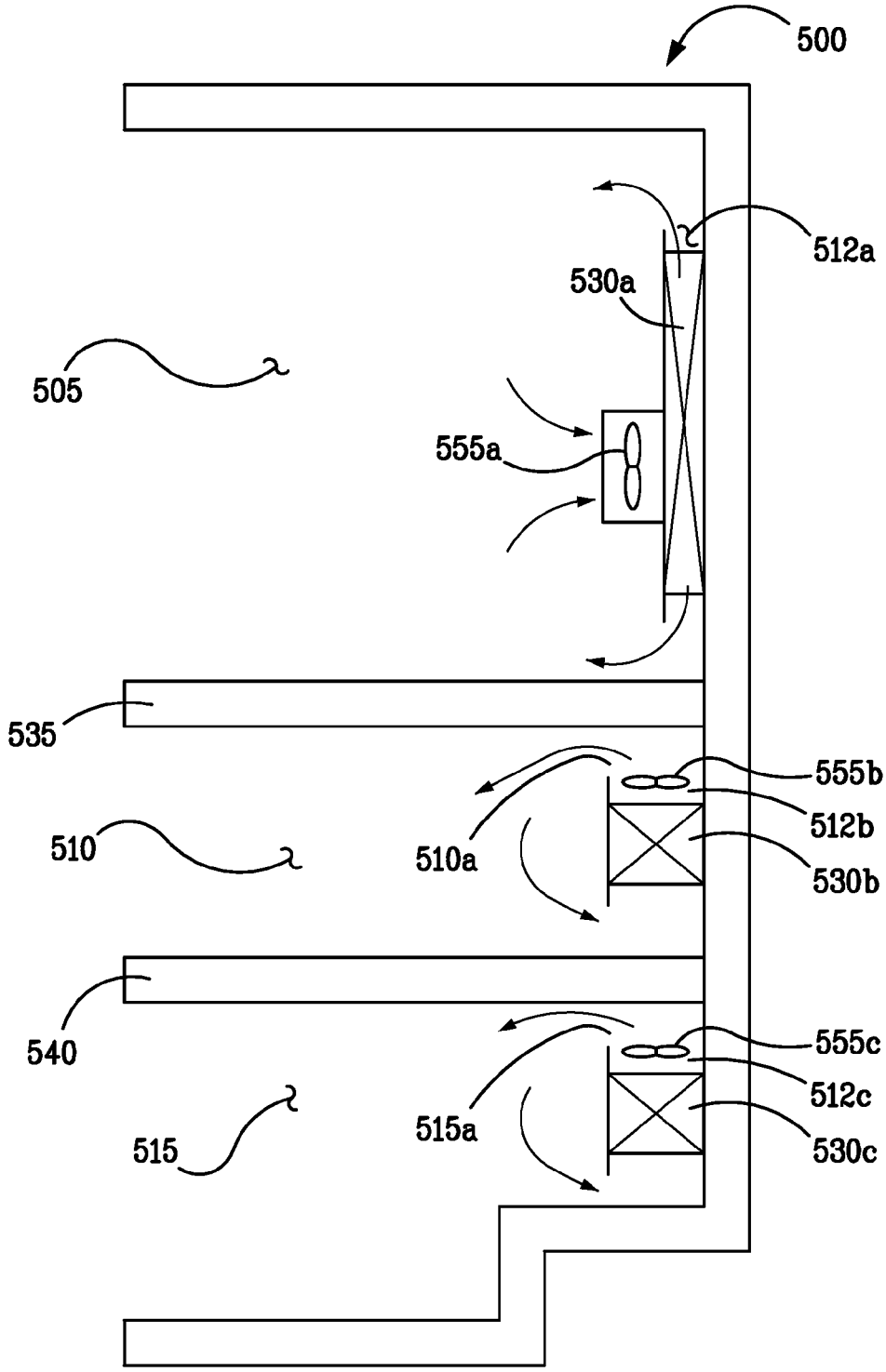

Turning now to FIGS. 5 and 5A, which show another embodiment according to the present disclosure, with three independent compartments 505, 510 and 515. In this embodiment, the same reference numerals plus 400 (i.e., 112 becomes 512) are used to designate the components that are the same or substantially similar to those shown in FIG. 2. When two identical or substantially similar units are used, letters such as "a" and "b" have been added to the chosen reference numeral. The unit 500 includes three evaporators 530*a*, 530*b* and 530*c*, which are each independent relative to one another. More specifically, the first evaporator 530*a* is used to cool the upper compartment 505, the second evaporator 530*b* is used to cool the middle compartment 510, and the third evaporator 530*c* is used to cool the lower compartment 515. The evaporators 530*a*, 530*b* and 530*c* are preferably disposed in respective sub-compartments 512*a*, 512*b* and 512*c* which are positioned in or immediately behind the compartments 505, 510 and 515, respectively. As is known in the art, the evaporators 530*a*, 530*b* and 530*c* can be operatively connected to a common compressor (not shown), or to their respective compressors (not shown), as is known in the art. It should be appreciated that there are no damper devices/return ducts in this embodiment, and each compartment 505, 510, 515 is segregated from one another by the first and the second mullions 535, 540. A first fan 555*a* is used to circulate refrigerated air from around the evaporator 530*a* to the upper compartment 505. Similarly, a second fan 555*b* is used to circulate refrigerated air from around the evaporator 530*b* to the middle compartment 510, and a third fan 555*c* is used to circulate refrigerated air from around the evaporator 530*c* to the lower compartment. Similar to the previously described embodiments, the second mullion 540 includes a heater 560. When desired, the heater 560 warms the air in the middle compartment 510, and therefore increases the temperature in the middle compartment 510 to provide the additional functionality and temperature modes as described above.

Figure 6:
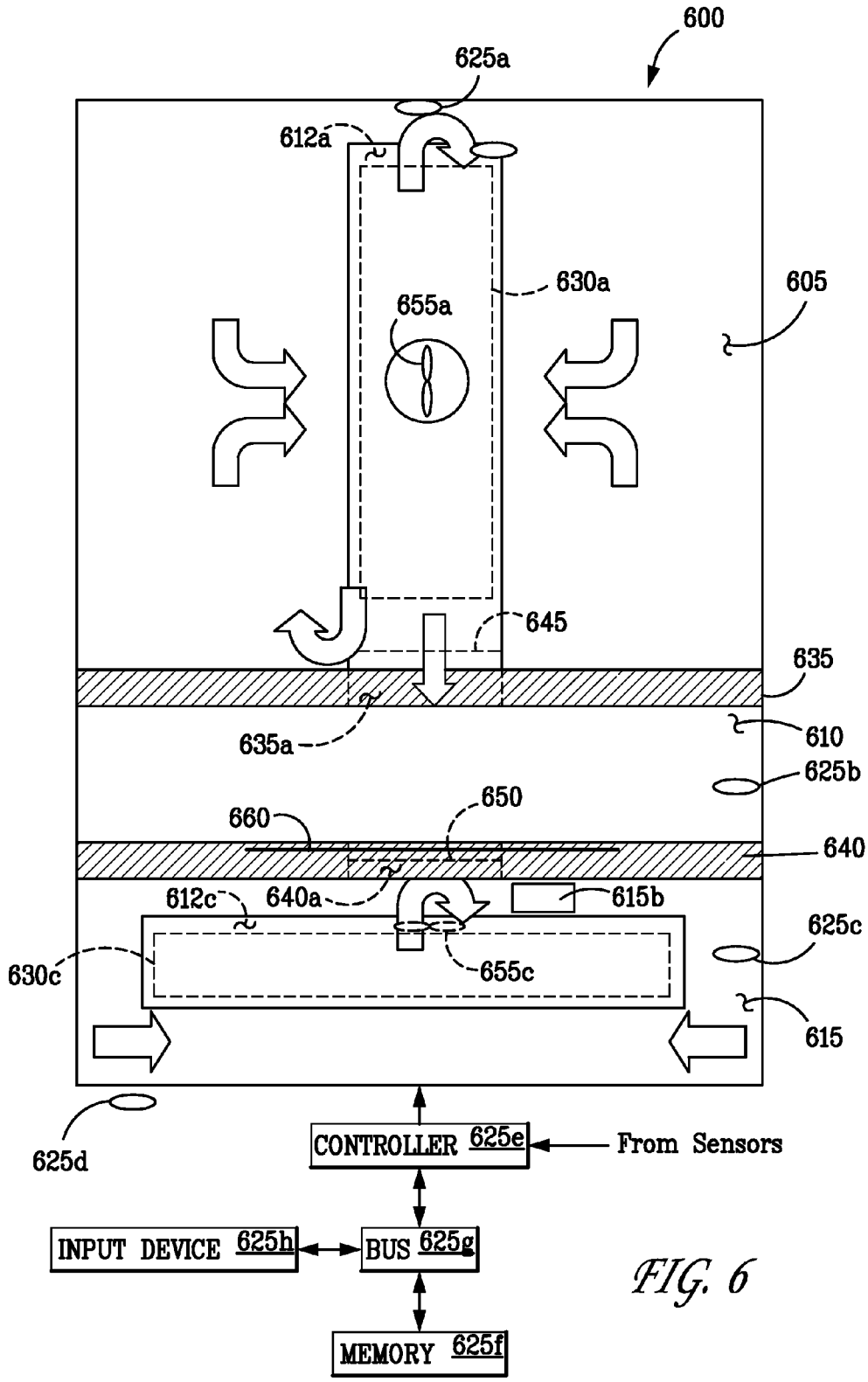
Figure 6A:
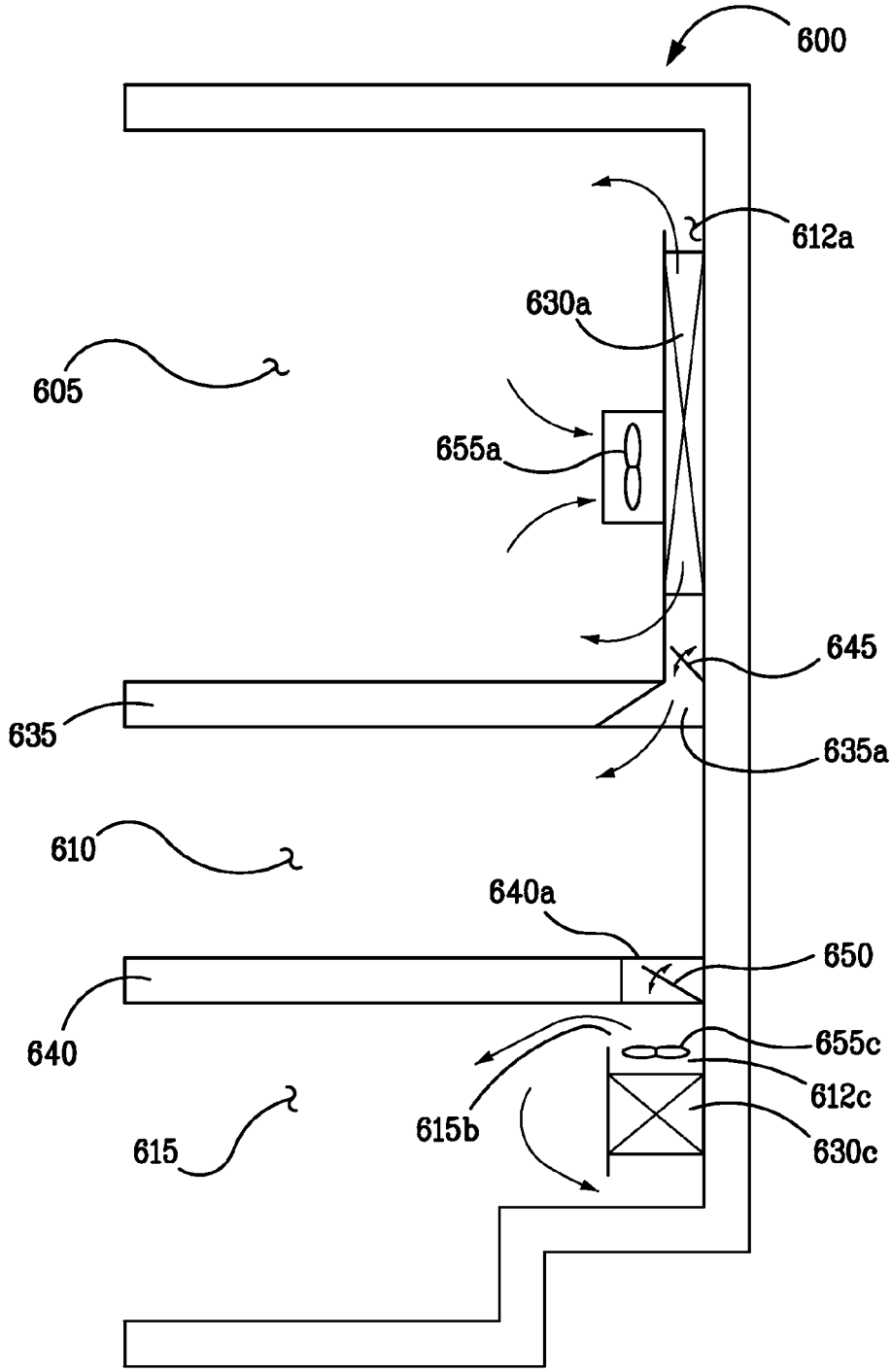

Turning now to FIGS. 6 and 6A, there is shown yet another embodiment of the present disclosure. In this embodiment, the same reference numerals plus 500 (i.e., 112 becomes 612) are used to designate the components that are the same or substantially similar to those shown in FIG. 2. When two identical or substantially similar units are used, letters such as "a" and "b" have been added to the chosen reference numeral. Compared with the embodiment shown in FIGS. 5 and 5A, this embodiment does not have an exclusive evaporator for the middle compartment 610. Rather, refrigerator air from around the evaporator 630*a* is used to cool the middle compartment 610 through an opening 635*a*, which can be formed on the first mullion 635, or through an air tower which extends from the sub-compartment 612*a* to the middle compartment 610. A first damper 645 is used to control the amount of refrigerated air that can flow into the middle compartment 610 from the upper compartment 605 through the opening 635*a* or the air tower. Each evaporator 630*a*, 630*b* may be independently controlled by the controller 625*e*. A second damper 650 is used to control the amount of refrigerated air that can flow into the middle compartment 615 from around the evaporator 630*c*. If the fluid communication between the middle and lower compartments 610, 615 is established through an opening 640*a* formed on the second mullion 640, the second damper 650 covers this opening 640*a*. A heater 660 is disposed on the second mullion 640 and preferably exposed to the middle compartment 610 to heat the air therein to a temperature with the desired mode set by the user using the input device 625*h*. Here, the middle compartment 610 can be cooled to a refrigeration temperature by opening the first damper 645 and energizing the first fan 655*a*. Alternatively, if the user desires that the temperature be lower, and the same as the lower compartment 615, then the middle compartment 610 can be selectively controlled to a freezer temperature by closing the first damper 645 and opening the second damper 650 to allow the refrigerated air from around the evaporator 630*c* to be circulated to the middle compartment 610. Additionally, if a relatively warmer temperature is desired, then both the dampers 645 and 650 can be closed, and/or the heater 660 can be energized to warm the middle compartment 610 to a desired temperature above that of the upper compartment 605.

Figure 7:
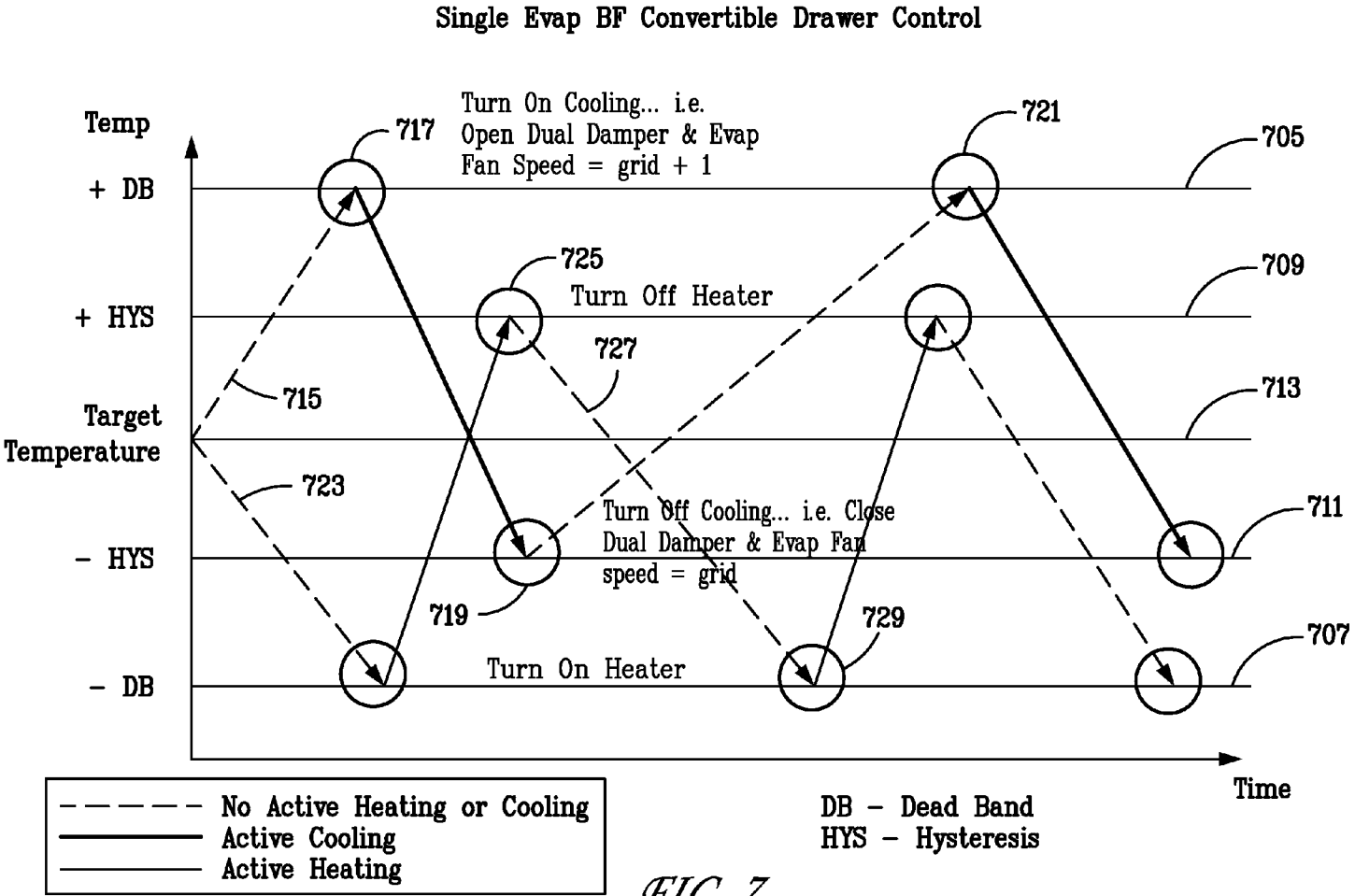
FIG. 7 shows a dead band and hysteresis temperature plot of controlling the multifunctional compartment between temperature levels for heating and cooling the multifunctional compartment of the refrigerator of FIG. 2.

FIG. 7 illustrates a plot of an actual temperature being plotted relative to a target temperature over unit time to illustrate the manner in which a single evaporator and heater component can control a compartment as illustrated in the configuration of FIG. 2. The temperature (y-axis) is plotted against time (x-axis) and the graph displays two dead band temperature plots and two hysteresis plots for temperature over time.

Turning now to reference numeral 705, there is shown a temperature bound or axis where cooling is needed. Here, to cool the desired compartment 110 both the dampers 145, 150 are opened, and the fan 155 is energized to provide cooling of the middle compartment 110, using the refrigerated air as described above with regard to FIG. 2.

Turning now to reference numeral 707, there is shown an axis or temperature bound to indicate where heating is needed in the middle compartment 110, and indicates a temperature of where the heater 160 is switched on to heat the middle compartment 110 of FIG. 2. At axis 709, this indicates an axis or temperature bound where the middle compartment 110 has been sufficiently heated, and the heater 160 should be switched off. Turning now to axis or temperature bound 711, there is shown a point where the desired cooling temperature has been reached to indicate that the first and second damper 145, 150 should be closed, and the fan speed should be modulated to a predetermined lesser amount. At axis or temperature bound indicated as reference numeral 713, this indicates the target temperature in the middle compartment 110 that is desired.

For the first example, shown as reference number 715, the passive heating of the middle compartment 110 occurs. At reference numeral 717, the first and the second dampers 145, 150 shown in FIG. 2 are opened and the first fan speed is engaged to a first predetermined rate of operation. Thereafter, the temperature is decreased from the upper limit 705 to the limit 711. At reference numeral 719 the cooling is switched off, by closing the first and the second dampers 145, 150, and the fan speed is lowered from the predetermined amount to a second lesser amount. The temperature will then passively increase from the temperature limit 711 to temperature limit 705. At reference number 721, the cycle will repeat for active cooling again back to the temperature level 711.

Turning now to reference number 723, the middle compartment 110 is shown for a different operational mode. Here, the middle compartment 110 is allowed to cool to a reference limit temperature 707. The middle compartment 110 will then be heated by the heater 160 to the temperature limit 709. At reference numeral 725, the heater 160 will be turned off, and the middle compartment 100 will be allowed to cool again along reference number 727 to the temperature limit 707. Here, at reference numeral 729, the cycle will repeat. It should be appreciated that various control configurations are possible, and the unit is not limited to the instant control configuration, and may be controlled in a different manner than articulated above.

Thus, while there have shown and described and pointed out fundamental novel features of the present disclosure as applied to exemplary embodiments thereof, it will be understood that various omissions and substitutions and changes in the form and details of the devices illustrated, and in their operation, may be made by those skilled in the art without departing from the spirit of the present disclosure. For example, it is expressly intended that all combinations of those elements and/or method steps which perform substantially the same function in substantially the same way to achieve the same results are within the scope of the present disclosure. Moreover, it should be recognized that structures and/or elements and/or method steps shown and/or described in connection with any disclosed form or embodiment of the present disclosure may be incorporated in any other disclosed or described or suggested form or embodiment as a general matter of design choice. It is the intention, therefore, to be limited only as indicated by the scope of the claims appended hereto.

What is claimed is:

1. A refrigerator comprising:

a first compartment;

a second compartment;

a multifunctional compartment disposed between the first compartment and the second compartment, the multifunctional compartment being adjustable between temperature modes selected from the group consisting of a fresh food temperature mode, a soft freeze mode, a freezer mode, and a chiller temperature mode; and a heater disposed in the multifunctional compartment and configured to adjust temperature in the multifunctional compartment.

2. The refrigerator of claim 1, further comprising a mullion which separates the multifunctional compartment from one of the first compartment and the second compartment.

3. The refrigerator of claim 2, wherein the multifunctional compartment is disposed above the one of the first compartment and the second compartment, and the heater is supported by the mullion.

4. A refrigerator comprising:

a first compartment;

a second compartment;

a multifunctional compartment disposed between the first compartment and the second compartment, the multifunctional compartment being adjustable between temperature modes selected from the group consisting of a fresh food temperature mode, a soft freeze mode, a freezer mode, and a chiller temperature mode;

a heater configured to adjust temperature in the multifunctional compartment;

a sub-compartment;

an evaporator disposed in the sub-compartment;

a fan for distributing cooling air from the sub-compartment to the multifunctional compartment;

a temperature sensor disposed in the multifunctional compartment for generating a temperature signal representing the temperature within the multifunctional compartment; and a controller operatively connected to the temperature sensor and the heater, the controller being configured to energize the heater after the temperature signal reaches a threshold.

5. The refrigerator of claim 4, further comprising a damper for selectively controlling an amount of the cooling air flowing into the multifunctional compartment from the sub-compartment.

6. The refrigerator of claim 4, wherein the first compartment is a fresh food compartment, and the second compartment is a freezer compartment.

7. The refrigerator of claim 6, further comprising a first sub-compartment, a second sub-compartment, a third sub-compartment, a first evaporator, a second evaporator and a third evaporator which are disposed in the first sub-compartment, the second sub-compartment and third sub-compartments, respectively, and a first fan, a second fan and a third fan for distributing cooling air from the first sub-compartment, the second sub-compartment and the third sub-compartment to the fresh food compartment, the multifunctional compartment, and the freezer, respectively.

8. The refrigerator of claim 4, further comprising a mullion which separates the multifunctional compartment from one of the first compartment and the second compartment, wherein the multifunctional compartment is disposed above the one of the first compartment and the second compartment, and the heater is supported by the mullion.

9. The refrigerator of claim 8, wherein the mullion has a surface facing an interior of the multifunctional compartment, the heater being placed on the surface.

10. A refrigerator comprising:

a fresh food compartment;

a freezer compartment;

a multifunctional compartment disposed between the fresh food compartment and the freezer compartment, the multifunctional compartment being adjustable between temperature modes selected from the group consisting of a fresh food temperature mode, a soft freeze mode, a freezer mode, and a chiller compartment temperature mode;

a heater configured to adjust temperature in the multifunctional compartment;

a first sub-compartment;

a first evaporator disposed in the first sub-compartment;

a first fan for distributing cooling air from the first sub-compartment to the, multifunctional compartment;

a temperature sensor disposed in the multifunctional compartment for generating a temperature signal representing the temperature within the multifunctional compartment; and a controller operatively connected to the temperature sensor and the heater, the controller being configured to energize the heater after the temperature signal reaches a threshold.

11. The refrigerator of claim 10, wherein the first fan is configured to distribute cooling air from the first sub-compartment to each of the fresh food compartment and the freezer compartment as well.

12. The refrigerator of claim 11, further comprising a conduit extending from the first sub-compartment to an upper location in the fresh food compartment, the first fan distributing cooling air from the first sub-compartment to the fresh food compartment through the conduit.

13. The refrigerator of claim 12, further comprising a first damper for selectively controlling an amount of cooling air flowing from the first sub-compartment to the conduit, and a second damper for selectively controlling an amount of cooling air flowing from the first sub-compartment to the multifunctional compartment.

14. The refrigerator of claim 12, further comprising a first damper for selectively controlling an amount of cooling air flowing from the first sub-compartment to the conduit, the mullion having an opening and a second fan for distributing cooling air from the one of the fresh food compartment and the freezer compartment to the multifunctional compartment.

15. The refrigerator of claim 10, further comprising a second sub-compartment, a second evaporator disposed in the second sub-compartment, and a second fan for distributing cooling air from the second sub-compartment to the freezer compartment.

16. The refrigerator of claim 15, wherein the first fan is configured to distribute cooling air from the first sub-compartment to the fresh food compartment as well.

17. The refrigerator of claim 16, further comprising a conduit extending from the first sub-compartment to an upper location in the fresh food compartment, the first fan being configured to distribute cooling air from the first sub-compartment to the fresh food compartment through the conduit.

18. The refrigerator of claim 17, further comprising a first damper for selectively controlling an amount of cooling air flowing from the first sub-compartment to the conduit, and a second damper for selectively controlling an amount of cooling air flowing from the first sub-compartment to the multifunctional compartment.

19. The refrigerator of claim 15, further comprising a conduit extending from the first sub-compartment to the multifunctional compartment, a first damper for selectively controlling an amount of cooling air flowing from the first sub-compartment to the conduit, and a second damper for selectively controlling an amount of cooling air flowing from the second sub-compartment to the freezer compartment.

20. A refrigerator comprising:

a fresh food compartment;

a freezer compartment disposed below the fresh food compartment;

a multifunctional compartment disposed between the fresh food compartment and the freezer compartment;

a heater disposed in the multifunctional compartment for increasing temperature in the multifunctional compartment;

a sub-compartment;

an evaporator disposed in the sub-compartment;

a fan for distributing cooling air from the sub-compartment to the multifunctional compartment;

a temperature sensor disposed in the multifunctional compartment for generating a temperature signal representing the temperature in the multifunctional compartment; and a controller operatively connected to the temperature sensor and the heater, the controller being configured to energize at least one of the heater and the fan after the temperature signal reaches a threshold.

* * * * *